US006786132B2

(12) United States Patent
Albert et al.

(10) Patent No.: US 6,786,132 B2
(45) Date of Patent: Sep. 7, 2004

(54) CONTROL DEVICE FOR HYDRAULICALLY OPERATED HOISTING MECHANISMS

(75) Inventors: Hermann Albert, Lebach (DE); Peter Bruck, Althornbach (DE); Alois Hoffmann, Saarbrücken (DE)

(73) Assignee: Hydac Fluidtechnik GmbH, Sulzbach/Saar (DE)

( * ) Notice: Subject to any disclaimer, the term of this patent is extended or adjusted under 35 U.S.C. 154(b) by 55 days.

(21) Appl. No.: 10/349,174

(22) Filed: Jan. 23, 2003

(65) Prior Publication Data

US 2003/0136124 A1 Jul. 24, 2003

(30) Foreign Application Priority Data

Jan. 24, 2002 (DE) ..... 102 02 607

(51) Int. Cl.[7] ..... F15B 11/08
(52) U.S. Cl. ..... 91/446; 60/406
(58) Field of Search ..... 91/446; 60/399, 60/406; 251/27; 137/52

(56) References Cited

U.S. PATENT DOCUMENTS 4,318,332 A * 3/1982 Shingu et al. ..... 91/446
4,835,966 A * 6/1989 Kauss et al. ..... 91/446
6,065,386 A * 5/2000 Rub et al. ..... 91/446

FOREIGN PATENT DOCUMENTS

DE 4423644 1/1996
DE 19622763 12/1997

* cited by examiner

*Primary Examiner*—Edward K. Look
*Assistant Examiner*—Michael Leslie
(74) *Attorney, Agent, or Firm*—Roylance, Abrams, Berdo & Goodman, L.L.P.

(57) ABSTRACT

A control device for hydraulically operated hoisting mechanisms used to raise and lower loads includes an electrically controllable throttle valve connected to a return line of the hoisting mechanism, and a pressure scale with at least one blocking position and one control position. The pressure scale operates in conjunction with an unblocking mechanism. When in its normal position, the pressure scale blocks the return line. The pressure scale assumes its control position in lowering of a load as a result of triggering of the unblocking mechanism. In the event of failure of the throttle valve, the pressure scale may be moved to its blocking position by the unblocking mechanism. In the event of failure of the pressure scale, the throttle valve assumes its blocking position. The load retention function is performed by two series-connected closed hydraulic actuators which can be electrically controlled individually. Both a hydraulic redundancy and an electric redundancy of the load retention function are provided as a result, so that higher safety requirements are satisfied.

11 Claims, 3 Drawing Sheets

CONTROL DEVICE FOR HYDRAULICALLY OPERATED HOISTING MECHANISMS

FIELD OF THE INVENTION

The present invention relates to a control device, particularly for hydraulically operated hoisting equipment used in raising and lowering loads. An electrically controllable throttle valve is connected to a return line of the hoisting equipment. A pressure scale is provided with at least one blocking position and one control position, and operates in conjunction with an unblocking mechanism.

BACKGROUND OF THE INVENTION

A generic hydraulic control device for hydraulically operated hoisting equipment is disclosed in DE 44 23 644 C2. The disclosed hydraulic control device is especially provided for lifting masts of fork lift trucks, and has a feed pump connected to a reservoir containing hydraulic fluid and a control piston connected to a return line acting as a pressure scale. The return line is connected to the reservoir. The control piston has an intake connected in the direction of pump delivery upstream from a return valve to a feed line connecting the pump to the hoisting equipment, and is connected by a control line to a connecting line between the pump and the return valve in such a way that the control piston performs the function of a delivery pressure scale in the direction of lowering and the function of a return pressure scale in the direction of hoisting. The control piston is subjected to the load applied by a spring associated with a pretensioning spring acting in the opposite direction. The spring force determines switchover of one control piston as an open pressure scale. When at rest, the spring is not subjected to external influence, and assumes a passage position. As a closed scale, and when at rest the spring has no external force applied to it, and assumes a blocking position. The control system is in the form of a two-way current regulator when the hoisting device moves in the lowering direction and in the form of a three-way current regulator when the device moves in the hoisting direction. The pressure difference in the area of the return valve is evaluated for the purpose of shifting the control piston from its function as delivery pressure scale to the function of the return pressure scale. In addition, a metering orifice designed as throttle valve is mounted between the control piston and the hoisting mechanism. The throttle valve itself is in the form of a two-way valve.

High requirements are set today for the lowering function of forklift trucks. Thus, in addition to the so-called "lift density", a load-independent limit is to be imposed on maximum speed; high lowering speeds are also to be possible when the lift fork is empty, along with sensitive metering of the lowering speed itself. The lowering function in modern forklifts is often performed by a seat valve with a constant opening behavior and a constant volume current regulator, or by a slide valve with delivery pressure scale. It is increasingly possible for seat or slide valve to be operated in proportion by electric means.

In the case of these electrically operated systems, standard EN 1175, Part 1 or 2 (safety of industrial trucks—electric requirements, general requirements for industrial trucks powered by an electric battery or internal combustion engine), requires that it be possible in any event to stop load movement if an error occurs.

An obvious possibility of meeting this requirement would to use an additional series-connected valve. However, this would distinctly reduce the lowering speed when the lift fork is empty, which is not desirable.

If, when a load is lowered by the hydraulic control device referred to above, as disclosed in DE 44 23 644 C2, the delivery pressure scale is kept in its open position, and the return line produces a fluid-conducting connection between the hoisting mechanism and the fluid reservoir in the form of the tank. In this instance, a blocking or switching unit is inserted into the return line upstream from the pressure scale. However, if a failure should occur in the associated blocking unit during the lowering process, the fluid-conducting path is essentially connected up to a throttle point. Also, a hoisting mechanism under load, in particular, may unintentionally move downward, causing considerably safety risks. Thus, the disclosed solution does not comply with Standard EN 1175-1 and 2.

DE 196 22 763 A1 discloses a valve system in the housing in which a spring-loaded valve element is mounted in the direction of closing. The valve element in question controls flow through a fluid channel whose intake may be connected to a fixed displacement pump and whose outlet may be connected to a tank. A control chamber on the side of the valve element is not subjected to pump pressure. A throttle is mounted between the fluid channel and the control chamber. A switching valve connects the control chamber to the tank when the valve is in its idle position, and interrupts this connection when it is in the operating position. An engaging/disengaging thrust bearing for the spring, when the pilot valve is in the operating position, increases the pretensioning of the spring relative to the rest position of the valve. To simplify the valve layout, the valve body and the slide gate of the pilot valve are mounted in a common bore, with a spring being guided between the valve body and the slide gate. The slide gate of the pilot valve serves as thrust bearing for the spring, at least as long as the connection between the control chamber and the tank has been interrupted. With such configuration, the valve layout may be used especially as a relief valve for a consuming device fed by a fixed displacement pump, such as a device in the form of a conventional forklift truck. The disclosed hydraulic valve layout permits the operating states "slow lift" and "fast lift," as well as "slow lowering" and "fast lowering," in addition to a "stop" operating state for the lift fork. While this disclosed solution permits high lowering speeds for an empty lift fork, the associated blocking unit may also experience failure during the lowering process, such as one in the form of stoppage. The disadvantage already described is that in particular a hoisting device (lift fork) under load may move downward unintentionally, resulting in considerable safety hazards.

SUMMARY OF THE INVENTION

Objects of the present invention are to provide a control device for hydraulically operated hoisting systems, which is compact, can be made at low production, permits a high lowering speed in normal operation with an empty lift fork, and improves safety so that even in the event of malfunction, an unintentional lowering of the hoisting device with or without load cannot occur.

The foregoing objects are attained by the present invention by the pressure scale, when in its normal position, blocking the return line. The pressure scale assumes its normal position during lowering as a result of triggering of the unblocking mechanism or device. The pressure scale may in the event of failure of the throttle be moved into its blocking position by the unblocking device. The throttle valve assumes its blocking position in the event of failure of the pressure scale. The load retaining function proper is performed by two series-connected hydraulic actuators which may be triggered individually by electric means. Both a hydraulic and an electric redundancy of the load retention function are thereby provided. As a result of the redundant design, the lowering movement is automatically halted, even in the event of failure of one of the two electric or of one of the two hydraulic actuators of the pressure scale and throttle valve.

The throttle valve is closed in the normal position, and is triggered electrically, preferably by way of a proportional pressure control valve. The pressure scale is designed as a delivery pressure scale so that it remains closed in the normal position and assumes the open control position only when the lowering function is actuated. The pressure scale piston is retained in the blocked position by a spring in the process. Unblocking of the piston occurs only as a result of triggering of an unblocking mechanism by way of a directional control valve in the event of presence of a lowering signal, and the pressure scale may perform its control function. If then, for example, the piston of the throttle valve remains in the open position in the event of an error after cutoff of the lowering signal, the movement of the load is then stopped by closing of the pressure scale (failsafe position). Since an additional series-connected valve may be eliminated from the control device of the present invention, the present invention may be applied cost effectively. In addition, the lowering speed during lowering with no load is not needlessly reduced by an additional flow resistance.

The requirement set by Standard EN 1175, Part 1 or Part 2, is also met by the redundant safety. Also, the movement of a load may in any case be halted in the event of an error.

In a preferred embodiment of the control device of the present invention, the unblocking mechanism is an unblocking cylinder with an energy storage element. The storage element is preferably in the form of a pressure spring tending to keep the pressure scale in its blocked position. A pressure supply acts by way of a emergency device with its fluid pressure in the direction opposite the force of the unblocking mechanism. The unblocking mechanism is accordingly capable of displacing the pressure scale in the direction of its blocked position and of retaining it reliably in this blocked position. The unblocking cylinder and the pressure scale preferably are coupled to each other mechanically by an actuating piston of the unblocking cylinder.

In another preferred embodiment of the control device of the present invention, a control line is connected to the return line between the hoisting mechanism and the throttle. This control line forwards the hydraulic pressure present as a control signal. The hydraulic pressure present between throttle valve and pressure scale is forwarded to the pressure scale by means of a tapping line as another control signal acting in the opposite direction. A current control function is thereby achieved.

Other objects, advantages and salient features of the present invention will become apparent from the following detailed description, which taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
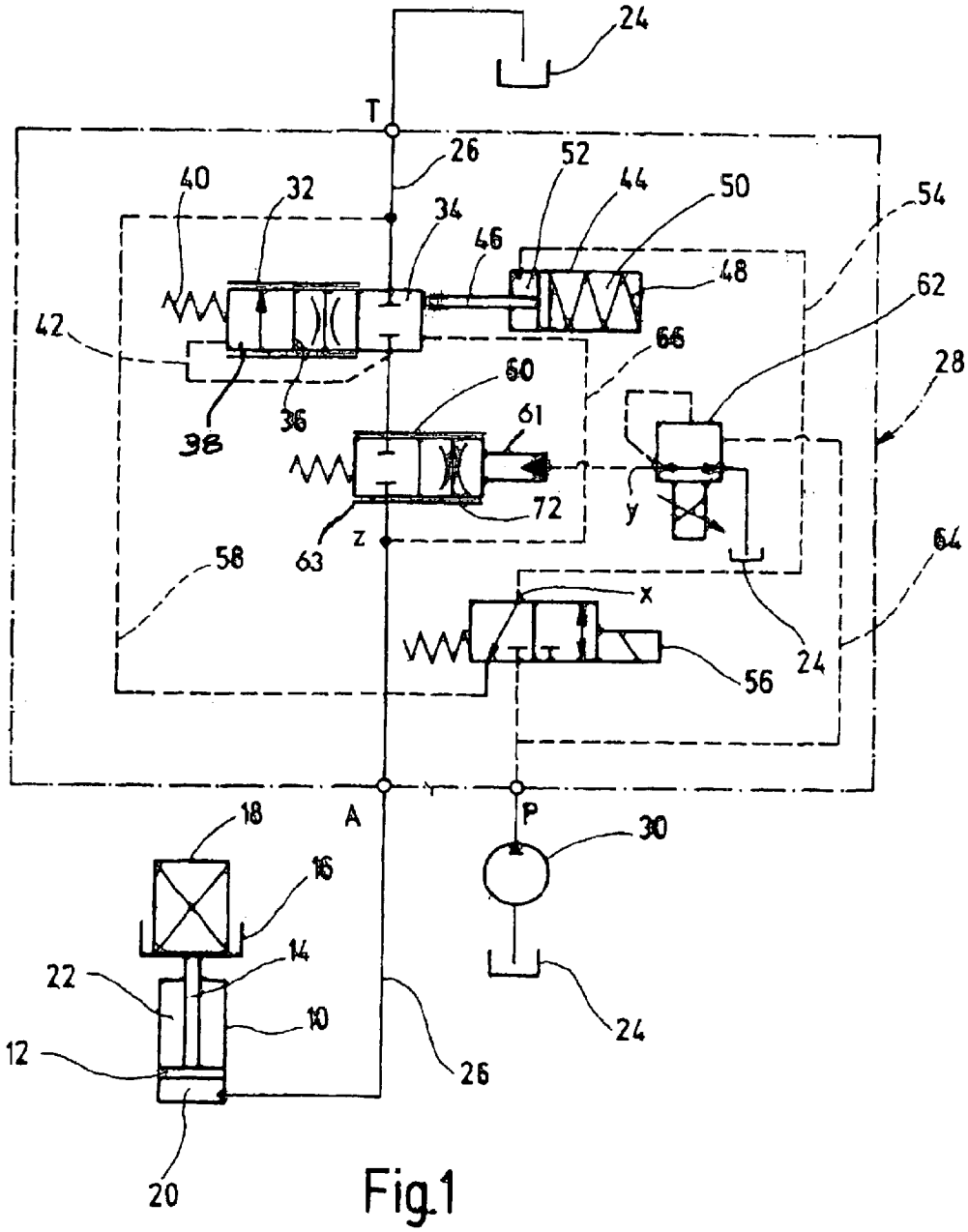
FIG. 1 is a schematic circuit diagram of a hoisting device with load compensation according to the present invention.

FIG. 1 illustrates a circuit diagram of one embodiment of a hydraulic control device of the present invention. The structural components are indicated only insofar as they are related to the lowering function for a hydraulically operated hoisting mechanism 10 with load compensation and a redundant safety switch device. The hoisting mechanism 10 is in the form of a hydraulic operating cylinder with an operating piston 12 and an actuating rod 14. The actuating rod 14 is connected at its one free end to the operating piston 12. The other actuating rod free end is connected to a load suspension device 16 charged, for example, with a unit load 18. The operating piston 12 inside the cylinder housing also divides this housing into a piston chamber 20 and a rod chamber 22. The hoisting mechanism 10 is to be represented by a lift mast of a forklift truck. It could also comprise entirely of a hydraulically operated lift mast or the like. A plurality (not shown) of hoisting mechanisms 10 arranged in logical sequence could also perform one more hoisting processes.

A valve block 28 is inserted into a return line 26 between the hoisting mechanism 10 and a fluid supply container 24 (tank). The valve block 28 has a connection A connected to the hoisting mechanism 10 and a connection T connected to the fluid supply container 24. The valve control block 28 also has a connecting point P for pressure supply, such as one in the form of a hydraulic pump 30. The pump intake side is also connected to the fluid supply container 24. However, pressure could also be supplied internally by way of the hydraulic circuit of the forklift truck.

The valve block 28 has a pressure scale 32, also known as a delivery pressure scale, connected to a return line 26. The pressure scale 32 is shown in FIG. 1 in its normal off position 34, in which it blocks the return line 26 from the fluid supply container 24. In addition to this normal or blocked position 34, the pressure scale 32 also has a control position 36 performing a throttle function. On its one operating side with pressure control spring 40, the pressure scale 32 is connected to a tap line 42. Tap line 42 is inserted into the return line 26 between a throttle valve and the pressure scale 32.

The pressure scale 32 operates in conjunction with an unblocking mechanism 44 designed as an unblocking cylinder with a piston rod component 46. Rod component 46 biases or strives by way of an energy storage unit 48, in the form of a pressure spring, to keep the pressure scale 32 in its normal or locked position 34. The energy storage unit 48 is mounted in the piston space 50, especially in the form of a piston ring space, of the unblocking cylinder.

The rod ring space 52 of the unblocking cylinder is connected by a fluid conducting connecting line 54 to the outlet X of an emergency device 56 in the form of a 3/2-way valve of conventional design. The emergency device 56 is also connected to the pressure supply 30 by way of the connection P. As is indicated in FIG. 1, the emergency device 56 is shown in its position blocking connection of connecting line 54 to the pressure supply 30. In the blocked position in question, the connecting line 54 is connected by discharge line 58 to the return line 26 and accordingly to the fluid supply container 24.

In addition, an electrically controllable throttle valve 60 is inserted in fluid communication into the return line 26 between hoisting mechanism 10 and pressure scale 32. Throttle valve 60 is a 2/2 way proportional slide valve, with a pilot unit 62 permanently connected by a direct connection 64 to the pressure supply 30. In its conducting position shown in FIG. 1 the pilot unit 62, which is a proportional pressure control valve, is connected to the fluid supply container 24. On its outlet side Y, the pilot unit is in actuating connection with the actuating side of the throttle valve 60. Consequently, in the normal position of the control device illustrated in FIGS. 1 and 2, the pressure scale 32 is held in its blocked position, making certain that, when pressure is absent from the line 54, the unblocking mechanism 44 will move the pressure scale 32 to its blocking position. If the connecting line 54 is kept free of pressure, the energy storage unit 48 is relieved of pressure and forces the piston rod component 46 out, with the result that the pressure scale 32 is located in the normal or blocked position 34. In any event, the residual stress or force of the energy storage unit 48 present is sufficient to move the pressure scale piston 68 to its blocking position in any operating position. A first safety step has already been taken as a result, and thus, ensures that the pressure scale 32 will not remain in its unblocked position 38 or control position 36 unintentionally in the event of failure.

A control line 66 transmits the hydraulic pressure present as control signal to the pressure scale 32 and is connected at connection point Z between the hoisting mechanism 10 and throttle valve 60. If the throttle valve 60 remains in its closed position as shown in FIG. 1, the volume flow which would possibly be forced from the piston compartment 20 on lowering of the load 18 would be measured at connection point Z and forwarded to the control line 66. This volume flow would then act in the same direction of action as the energy storage unit 48 in an effort to keep the pressure scale 32 in its blocked position or to move it there for this purpose.

The individual switching and valve functions for the lowering function according to FIG. 1 are discussed in greater detail with reference to FIG. 2 and following figures. The same components indicated in the circuit diagram in FIG. 1 are identified by the same reference numbers in FIG. 2 and following figures. The previous descriptions also apply to that extent in the following description.

Figure 2:
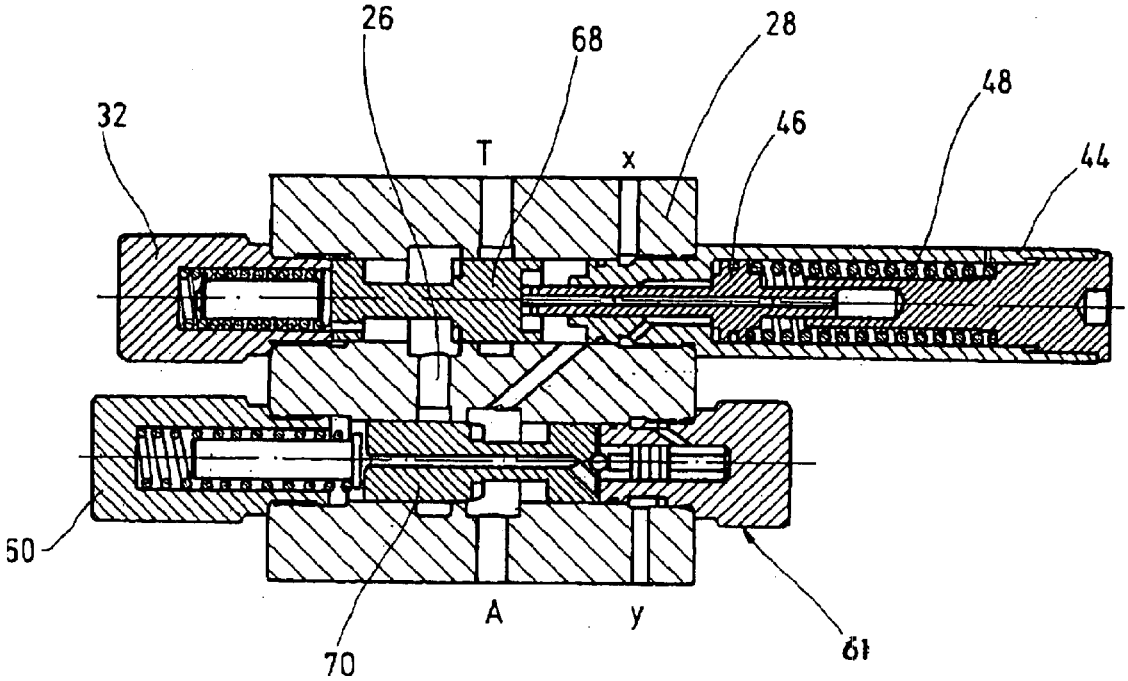
FIG. 2 is a side-elevational view in section of the valve block of FIG. 1 in its normal position.

FIG. 2 illustrates the valve block with valve components for the switching device in the normal position for the lowering function as indicated in the circuit diagram in FIG. 1. The delivery pressure scale 32 is shown in its normal or blocking position 34, in which the tank connection T is uncoupled from or closed to the return line 26. The unblocking mechanism 44 has its piston rod component 46 in contact with the control piston 68 of the pressure scale 32. The energy storage unit in the form of the pressure spring 48 has pressure removed from it except for a predetermined residual stress. The throttle valve 60 has its directional control slide valve piston 70 operationally connected to the pilot unit 61. Connection A is separated from the tank connection T by the return line 26.

Figure 3:
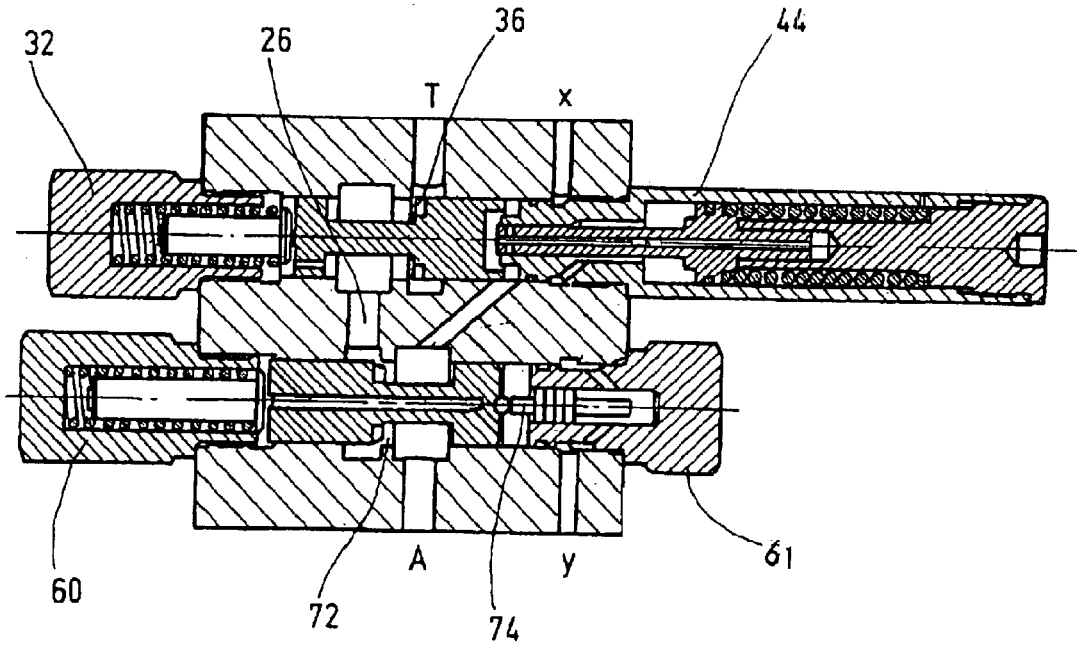
FIG. 3 is a side-elevational view in section of the valve block at FIG. 1 in its control position.

If the pressure scale 32 is now to assume its control position 36 as shown in FIG. 3, a lowering signal is sent by way of a suitable actuating device such as a joystick (not shown) and the emergency device 56 is simultaneously and automatically activated. The pressure supply 30 is connected to the connecting line 54, and pressure is conducted during operation. The fluid pressure of the pressure supply 30 then penetrates the rod ring space 52 of the unblocking mechanism 44 and slides the piston rod component 46 to the right as viewed in FIG. 1, against the bias of the energy storage unit 48, into the corresponding housing components. As a result, however, the control position 36 of the pressure scale 32 then moves into the fluid-conducting connecting position between piston space 20 and the fluid supply container 24 by way of the return line 26. In this process, the direct connection 64 actuates the pilot unit 62 (proportional pressure control valve) by pressure such that the other pilot unit 61 may be actuated. The directional control slide valve piston 70 is moved, as viewed in FIGS. 2 and 3, from its position closing the return line 26 to the throttle position 72 (FIG. 3). In the relevant switching position shown in FIG. 3 the load suspension device 16 is continuously and evenly lowered under the load 18. The relevant lowering process may be automatically readjusted, so that a more or less constant lowering rate as determined manually may be maintained independently of the load 18. The lowering rate is then dependent on the throttle position of the directional control slide valve piston 70, independently of the load 18.

Figure 4:
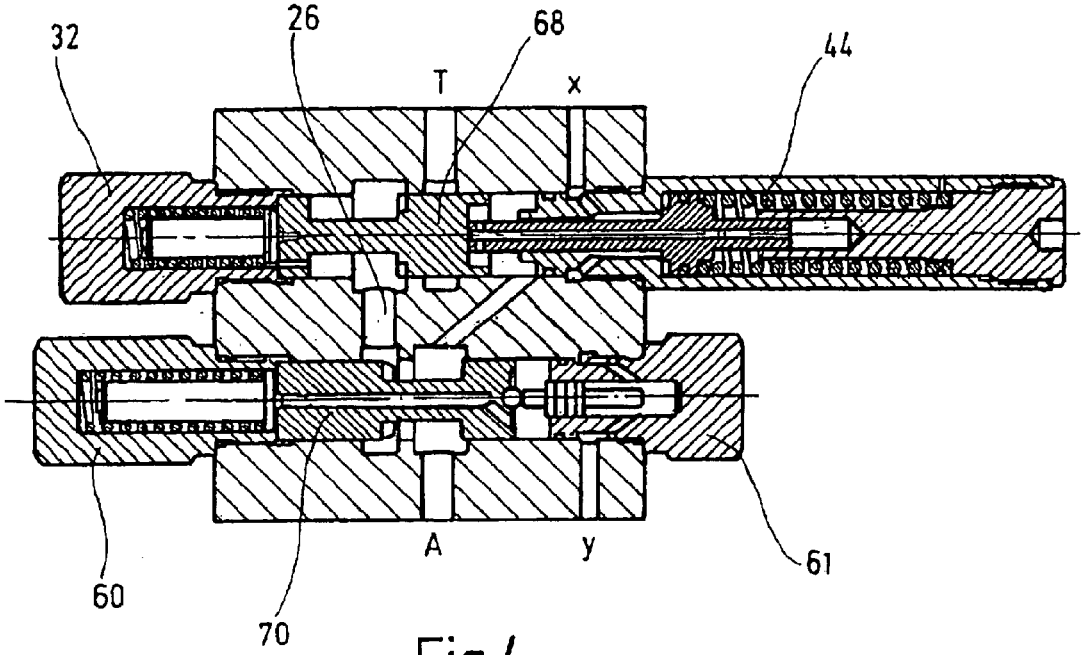
FIG. 4 is a side-elevational view in section of the valve block of FIG. 1 in its failsafe position.

Should an error occur now, in the control position shown in FIG. 3 the load suspension device 16 with its load 18 would of itself descend out of control. However, if the emergency device 56 is no longer activated, this device assumes the blocking position shown in FIG. 1. The connecting line 54 to the unblocking mechanism 44 is kept without pressure. In this case, the energy storage unit 48 slides the energy storage unit 48 out and moves the pressure scale 32 to its normal or blocking position 34. Should a malfunction occur in the process, for example, should the emergency device 56 remain in its connected position or the pressure scale 32 be jammed, it would still be possible to disconnect by way of the throttle valve 60. Valve 60 would assume its locked position 63 as illustrated in FIG. 1, under the influence of its actuating spring. If a malfunction occurs in the area of the throttle valve 60, in the form of a jam, for example, the pressure scale 32 is in any event capable of interrupting the lowering function directly by way of its mechanical unblocking cylinder unit 44. The relevant interruption position, in which the control piston 68 reliably interrupts the fluid connection between return line 26 and connecting point T to the fluid supply container 24, is illustrated in FIG. 4.

Figure 5:
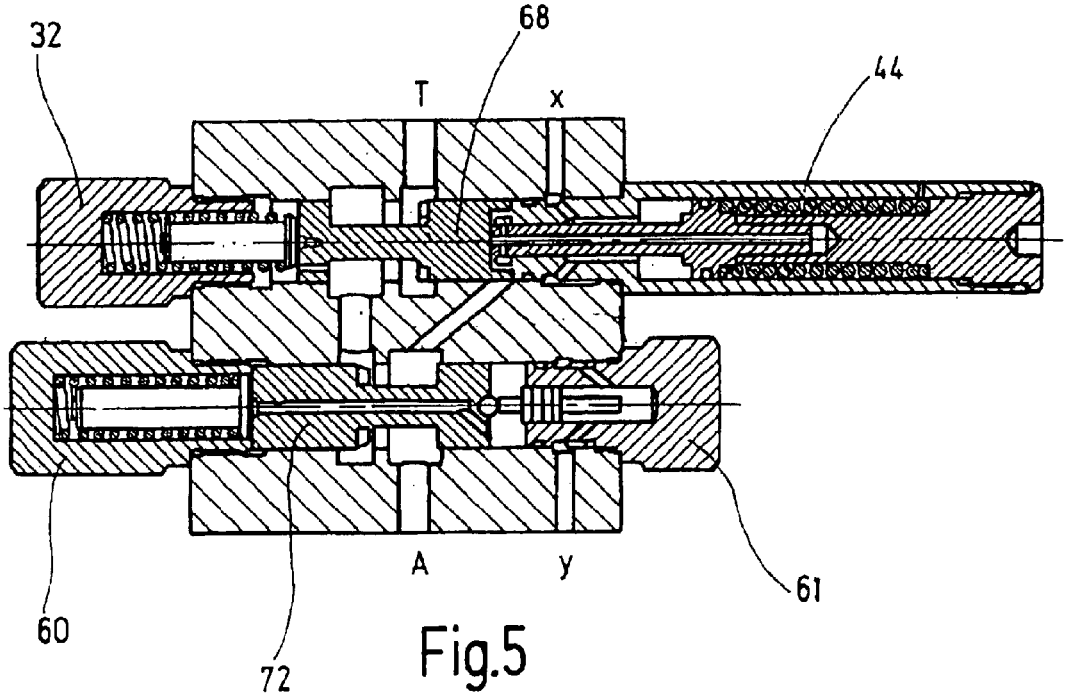
FIG. 5 is a side-elevational view in section of the valve block of FIG. 1 during lowering without a load.

If the pressure scale 32, as illustrated in FIG. 5, is moved to a "lowering without load" position, both the control piston 68 and the directional control slide valve piston 70 are switched to an open passage position or to a throttle position. In this way, a quick lowering function may be reached under controlled conditions. This takes place automatically if the load pressure is lower than the control pressure.

The current regulator with redundant stop function (failsafe) of the present invention thus permits load-independent assignment of speed and a high lowering speed even with the lift fork empty, along with precise metering of the lowering speed.

While one embodiment has been chosen to illustrate the invention, it will be understood by those skilled in the art that various changes and modifications can be made therein without departing from the scope of the invention as defined in the appended claims.

What is claimed is:

1. A control device for hydraulically operated hoisting mechanisms for raising and lowering loads, comprising:

an electrically controllable throttle valve in fluid communication with a hoisting mechanism return line;

a pressure scale having at least one normal blocking position and one control position and connected to said return line to block said return line in said blocking position, said pressure scale being movable into said control position during load lowering to permit controlled fluid flow through said return line; and an unblocking mechanism operating in conjunction with and connected to said pressure scale to move said pressure scale to said control position during load lowering and to said blocking position upon failure of said throttle valve, said throttle valve moving to a blocking position closing fluid flow through said return line upon failure of said pressure scale.

2. A control device according to claim 1 wherein said unblocking mechanism comprises an unblocking cylinder with an energy storage unit biasing said pressure scale toward said blocking position thereof; and a pressure supply unit connected by an emergency device to said unblocking mechanism to supply fluid pressure to said unblocking mechanism to act against biasing of said energy storage unit.

3. A control device according to claim 2 wherein said energy storage unit is a pressure spring.

4. A control device according to claim 2 wherein said unblocking cylinder and said pressure scale are mechanically connected by an operating piston in said unblocking cylinder.

5. A control device according to claim 4 wherein said emergency device comprises a 3/2-way valve.

6. A control device according to claim 2 wherein said emergency device comprises a 3/2-way valve.

7. A control device according to claim 1 wherein said throttle valve is connected to and is constantly controlled by a proportional pressure control valve, said proportional pressure control valve being permanently connected to a pressure supply source by a direct connection.

8. A control device according to claim 1 wherein a control line is connected to said pressure scale and to said return line between the hoisting mechanism and said throttle valve, and transmits fluid pressure from said return line to said pressure scale as a first control signal; and a tap line is connected to said pressure scale and to said return line between said throttle valve and said pressure scale, and conveys from said return line to said pressure scale as a second control signal having an effect opposite to said first control signal.

9. A control device according to claim 7 wherein a control line is connected to said pressure scale and to said return line between the hoisting mechanism and said throttle valve, and transmits fluid pressure from said return line to said pressure scale as a first control signal; and a tap line is connected to said pressure scale and to said return line between said throttle valve and said pressure scale, and conveys from said return line to said pressure scale as a second control signal having an effect opposite to said first control signal.

10. A control device according to claim 9 wherein said pressure scale, said unblocking mechanism, said throttle valve and said pressure control valve are housed in a single valve block as one structural unit.

11. A control device according to claim 7 wherein said pressure scale, said unblocking mechanism, said throttle valve and said pressure control valve are housed in a single valve block as one structural unit.

* * * * *